US008891805B2

(12) United States Patent
Han et al.

(10) Patent No.: US 8,891,805 B2
(45) Date of Patent: Nov. 18, 2014

(54) SPEAKER APPARATUS

(75) Inventors: Jung-Eun Han, Gyeonggi-do (KR); Jang-Hoon Kang, Seoul (KR); Ki-Won Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 150 days.

(21) Appl. No.: 13/440,329

(22) Filed: Apr. 5, 2012

(65) Prior Publication Data

US 2012/0321120 A1 Dec. 20, 2012

(30) Foreign Application Priority Data

Jun. 14, 2011 (KR) ..... 10-2011-0057511

(51) Int. Cl.
*H04R 1/02* (2006.01)
*H04R 25/00* (2006.01)
*H04R 9/06* (2006.01)

(52) U.S. Cl.
CPC ..... *H04R 9/06* (2013.01)
USPC ..... 381/387; 381/162; 381/165; 181/185; 181/186; 181/198; 181/199

(58) Field of Classification Search
CPC ..... H04R 11/00; H04R 17/00; H04R 11/02; H04R 1/42; H04R 23/00; H04R 23/004
USPC ..... 381/162, 165, 313, 387; 181/185, 186, 181/198, 199; 13/162, 165, 313, 387
See application file for complete search history.

(56) References Cited

U.S. PATENT DOCUMENTS

| | | | | | |
|---|---|---|---|---|---|
| 2,547,447 | A * | 4/1951 | De Boer Kornelis | 181/145 |
| 4,005,278 | A * | 1/1977 | Gorike | 381/373 |
| 5,447,461 | A * | 9/1995 | Liao | 446/301 |
| 5,686,678 | A * | 11/1997 | Greenhoe | 84/390 |
| 6,438,227 | B1 * | 8/2002 | Kretsch | 379/433.02 |
| 7,583,938 | B2 * | 9/2009 | Kim | 455/90.3 |
| 7,735,599 | B2 * | 6/2010 | Kubota | 181/192 |
| 7,756,286 | B2 * | 7/2010 | Kim | 381/388 |
| 2004/0055811 | A1 * | 3/2004 | Shih | 181/129 |
| 2004/0135476 | A1 * | 7/2004 | Gillengerten | 312/8.16 |
| 2005/0049018 | A1 * | 3/2005 | Chiang et al. | 455/575.1 |
| 2006/0091747 | A1 * | 5/2006 | Yamaguchi et al. | 310/81 |
| 2011/0002487 | A1 | 1/2011 | Panther et al. | |

* cited by examiner

*Primary Examiner* — Matthew Eason
*Assistant Examiner* — Sean H Nguyen
(74) *Attorney, Agent, or Firm* — Cha & Reiter, LLC

(57) ABSTRACT

A speaker apparatus selects a path which emits a speaker sound. The speaker apparatus includes a speaker unit for outputting the sound generated from voice data, a body including at least one or more emission paths for guiding and emitting the sound output from the speaker unit, and a member for opening or shutting out at least one emission path.

16 Claims, 4 Drawing Sheets

SPEAKER APPARATUS

CLAIM OF PRIORITY

This application claims, pursuant to 35 U.S.C. §119(a), priority to and the benefit of a Korean patent application filed in the Korean Intellectual Property Office on Jun. 14, 2011 and assigned Serial No. 10-2011-0057511, the entire disclosure of which is hereby incorporated by reference.

BACKGROUND OF THE INVENTION

1. Field of the Invention

The present invention relates to a speaker apparatus. More particularly, the present invention relates to a speaker apparatus capable of selecting a path which emits a speaker sound.

2. Description of the Related Art

Portable terminals such as mobile communication terminals (cellular phones), electronic schedulers, and Personal Digital Assistants (PDAs) have become necessities of current society due to the rapid development of electronic communication industries. Portable terminals have developed into important means of information transmission, which are quickly changing the manner in which information is used and managed. In this situation, functions have been gradually added to portable terminals, and portable terminals are characterized by their lightness, thinness, compactness, and smallness.

In general, a portable terminal includes a speaker apparatus for outputting a sound corresponding to voice data and/or any other types of sounds and audio-related data, such as music data, audio alerts, etc. The speaker apparatus includes a speaker unit for generating a sound and an internal structure which forms a path for emitting the sound output from the speaker unit. This internal structure typically has one emission path. However, this singular emission path may result in the following problem. For example, an outlet for emitting a speaker sound may be shut out or blocked while the portable terminal is positioned, for example, against an interior surface of a pocket or a handbag. In addition, when the number of emission paths is limited, there is a limit to improvement of sound quality.

SUMMARY OF THE INVENTION

An aspect of the present invention is to solve at least the above-mentioned problems and/or disadvantages and to provide at least the advantages described below. Accordingly, an aspect of the present invention is to provide a speaker apparatus capable of improving sound quality.

Another aspect of the present invention is to provide a speaker apparatus capable of having a plurality of emission paths for emitting a speaker sound and selectively using a corresponding emission path.

In accordance with the present invention, a speaker apparatus is provided. The speaker comprises a speaker unit for outputting a sound corresponding to voice data, a body including at least one or more emission paths for guiding and emitting the sound output from the speaker unit, and a member for opening or shutting out at least one emission path.

In accordance with the present invention, an alternative speaker apparatus is provided. The alternative speaker apparatus comprises a rotatable speaker unit for emitting a sound corresponding to voice data, a weight member, attached to the speaker unit, for generating a moment and rotating the speaker unit, and a body including at least one or more outlets, wherein a sound is emitted through a corresponding outlet of the body according to a rotation direction of the speaker unit.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION OF THE INVENTION

Hereinafter, preferred embodiments of the present invention will be described herein below with reference to the accompanying drawings. This invention may, however, be embodied in many different forms and should not be construed as limited to the exemplary embodiments set forth herein. For the purposes of clarity and simplicity, well-known functions or constructions are not described in detail as they would obscure the invention in unnecessary detail. Also, the terms used herein are defined according to the functions of the present invention. Thus, the terms may vary depending on user's or operator's intention and usage. That is, the terms used herein must be understood based on the descriptions made herein. The principles and features of this invention may be employed in varied and numerous embodiments without departing from the scope of the invention.

Furthermore, although the drawings represent exemplary embodiments of the invention, the drawings are not necessarily to scale and certain features may be exaggerated or omitted in order to more clearly illustrate and explain the present invention.

Among the terms set forth herein, a terminal refers to any kind of device capable of processing data which is transmitted or received to or from any external entity. The terminal may display icons or menus on a screen to which stored data and various executable functions are assigned or mapped. The terminal may include a computer, a notebook, a tablet PC, a mobile device, and the like.

Among the terms set forth herein, a screen refers to a display or other output devices which visually display information to the user, and which optionally are capable of receiving and electronically processing tactile inputs from a user using a stylo, a finger of the user, or other techniques for conveying a user selection from the user to the output devices.

The present invention described hereinafter relates to a speaker apparatus. More particularly, the present invention relates to a speaker apparatus capable of selecting a path for emitting a speaker sound according to the orientation and positional conditions of the speaker apparatus.

Figure 1:
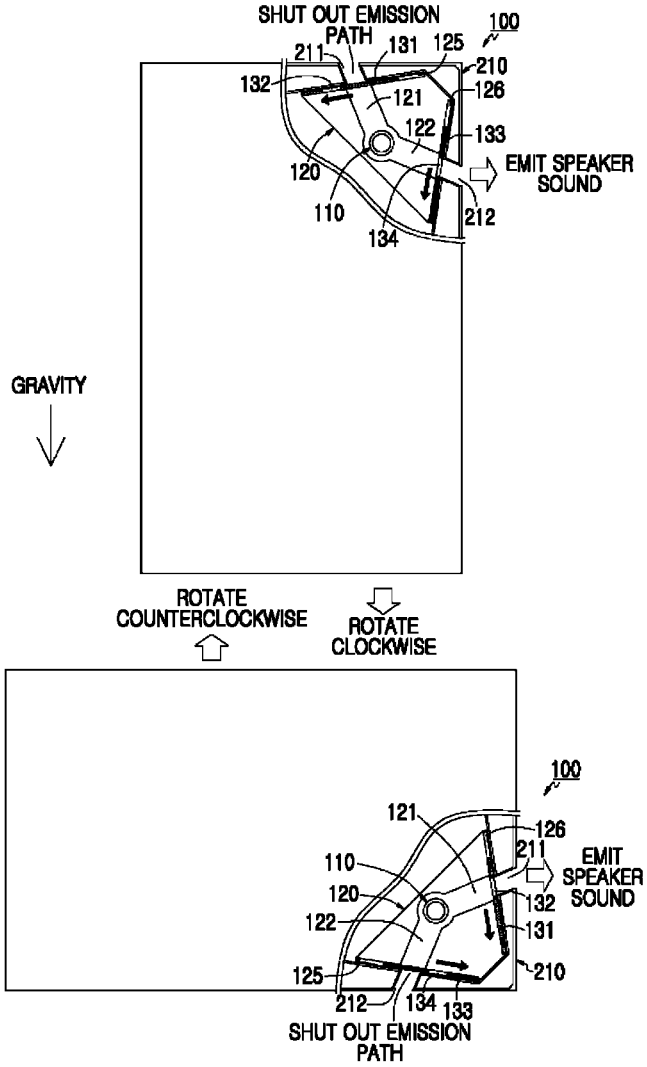
FIG. 1 illustrates a configuration and an operation of a speaker apparatus according to a first embodiment of the present invention.

FIG. 1 illustrates a configuration and an operation of a speaker apparatus according to a first embodiment of the present invention.

Referring to FIG. 1, the speaker apparatus denoted by 100 includes a body 120 and the following elements formed in the body 120. The speaker apparatus 100 includes a speaker unit 110 for outputting a sound corresponding to voice data provided from a corresponding device such as a mobile terminal functioning as a cell phone. It is to be understood that the speaker apparatus 100 may also output any other types of sounds, including sounds corresponding to other types of data including audio-related data, such as music data, audio alerts, etc.

The speaker apparatus 100 also includes a plurality of internal emission paths, that is, a first emission path 121 and a second emission path 122 for guiding the sound generated from the speaker unit 110 and emitting the guided sound to the outside of the body 120. In addition, the speaker apparatus 100 includes a first bar 131 and a second bar 133 which are slidably movable to permit emission of the sound through each of the first emission path 121 and the second emission path 122, or to shut out or block the emission of the sound. The speaker apparatus 100 also includes a first guide part 125 and a second guide part 126 for guiding movement of each of the first bar 131 and the second bar 133, respectively. Each of the first bar 131 and the second bar 133 includes each of a corresponding first through hole 132 and second through hole 134, respectively. Each of the first through hole 132 and the second through hole 134 may be or may not be opened into each of the corresponding first emission path 121 and second emission path 122 according to movement of each of the first bar 131 and the second bar 133, respectively. In particular, each of the first bar 131 and the second bar 133 moves in each of the corresponding first guide part 125 and second guide part 126, respectively, in response to the load or weight of each of the bars 131, 133, due to gravity and due to a slope of the guide parts 125, 126 which are slantingly oriented relative to a predetermined surface of the body 120, such that the bars 131, 133 are subject to the vertically oriented gravity, shown in FIG. 1, to move due to gravity within respective guide parts 125, 126.

As shown in FIG. 1, the speaker apparatus 100 includes the first emission path 121 and the second emission path 122 which are symmetrically formed about a common point, such as the speaker unit 110. Elements of the first emission path 121 and the second emission path 122 may also be symmetrically formed. However, such symmetries are example embodiments, but the present invention is not limited to the shown and described symmetrical elements.

The speaker apparatus 100 may be inserted and fixed into a case frame 210 which forms or has the appearance of a portable terminal. In some cases, it is possible to replace the body 120 with the case frame 210 of the portable terminal in the speaker apparatus 100. In accordance with one embodiment of the present invention, it is assumed herein, solely for the purpose of describing the exemplary embodiments, that the speaker apparatus 100 is installed at a right upper part of a longitudinal (vertical) direction within the case frame 210, as shown in the upper view of FIG. 1, but it is understood that the speaker apparatus 100 may be positioned in other locations within the case frame 210. In the exemplary embodiment shown in FIG. 1, for the speaker apparatus 100, a sound emitted along the first emission path 121 is emitted to an upper part of the portable terminal which is vertically positioned, and a sound emitted along the second emission path 122 is emitted to a right side of the portable terminal which is vertically positioned. Therefore, the case frame 210 of the portable terminal includes a first outlet 211 capable of being opened for communicating with the first emission path 121, and a second outlet 212 capable of being opened for communication with the second emission path 122. Each of the first outlet 211 and the second outlet 212 is opened to connect to the outside of the case frame 210. The first bar 131, which is movable to allow a sound to be output from the first emission path 121 or to shut out or block the sound from the first emission path 121, is interposed between the first outlet 211 and the first emission path 121 to connect or disconnect the first emission path 121 with the first outlet 211 according to the movement of the first bar 131. In the same manner, the second bar 133, which is movable to allow a sound to be output from the second emission path 122 or to shut out or block the sound from the second emission path 122, is interposed between the second outlet 212 and the second emission path 122 to connect or disconnect the second emission path 122 with the second outlet 212 according to the movement of the second bar 133. In accordance with one embodiment, the first guide part 125 and the second guide part 126 are installed such that the first bar 131 and the second bar 133, respectively associated with the first guide part 125 and the second guide part 126, may move along the respective guide parts 125, 126, with each of the guide parts 125, 126 being oriented slantingly relative to a surface of the body 120 or the case frame 210, for example, the surface may be either a horizontal or vertical surface of the body 120 or case frame 210 of the speaker apparatus 100 shown in either orientation in FIG. 1.

When the portable terminal is vertically oriented, as shown in the upper view of FIG. 1, the bars 131, 133 are under the influence of gravity, and so the first bar 131 slantingly moves down to the left, which positions a solid portion of the first bar 131 without the first through hole 132 to be adjacent to the first emission path 121 and the first outlet 211, which then shuts out or blocks the first emission path 121, and so the first emission path 121 does not emit a speaker sound to the first outlet 211. On the other hand, the second bar 133 slantingly moves down to the left, which positions a portion of the second bar 133 having the through hole 134 to be adjacent to both the second emission path 122 and the second outlet 212, which then connects the second emission path 122 with the second outlet 212 through the second through hole 134, and so the second emission path 122 emits a speaker sound to the second outlet 212, and accordingly to the right side of the case frame 210. As described above, each of the first bar 131 and the second bar 133 slidably moves in each of the corresponding first guide part 125 and second guide part 126 due to the load and weight of each bar 131, 133, respectively, under the influence of the vertically oriented gravity.

When the portable terminal is horizontally oriented, as shown in the lower view of FIG. 1, in which the portable terminal has been rotated clockwise relative to the orientation in the upper view of FIG. 1, the first bar 131 slantingly moves down to the right, which moves a portion of the first bar 131 having the first through hole 132 to be adjacent to both the first emission path 121 and the first outlet 211, which then connects the first emission path 121 with the first outlet 211 through the first through hole 132, and so the first emission path 121 emits a speaker sound to the first outlet 211, and accordingly to the right side from the case frame 210. The second bar 133 slantingly moves down to the right, which positions a solid portion of the second bar 133 without the second through hole 134 to be adjacent to both the second emission path 122 and the second outlet 212, which then shuts out or blocks the second emission path 122, and so the second emission path 122 does not emit a speaker sound to the second outlet 212.

In the exemplary embodiment, each of the first guide part 125 and the second guide part 126 is slantingly installed. Accordingly, regardless of whether the portable terminal is vertically or horizontally oriented, each of the first bar 131 and the second bar 133 may move slidably due to its load or weight under the influence of the vertically directed gravity.

As described above, the speaker apparatus 100 according to one embodiment of the present invention determines a different emission path according to rotation of the portable terminal and emits a sound corresponding to voice data or other audio data to an outlet corresponding to an emission path determined by the orientation or rotation of the portable terminal.

Figure 2A:
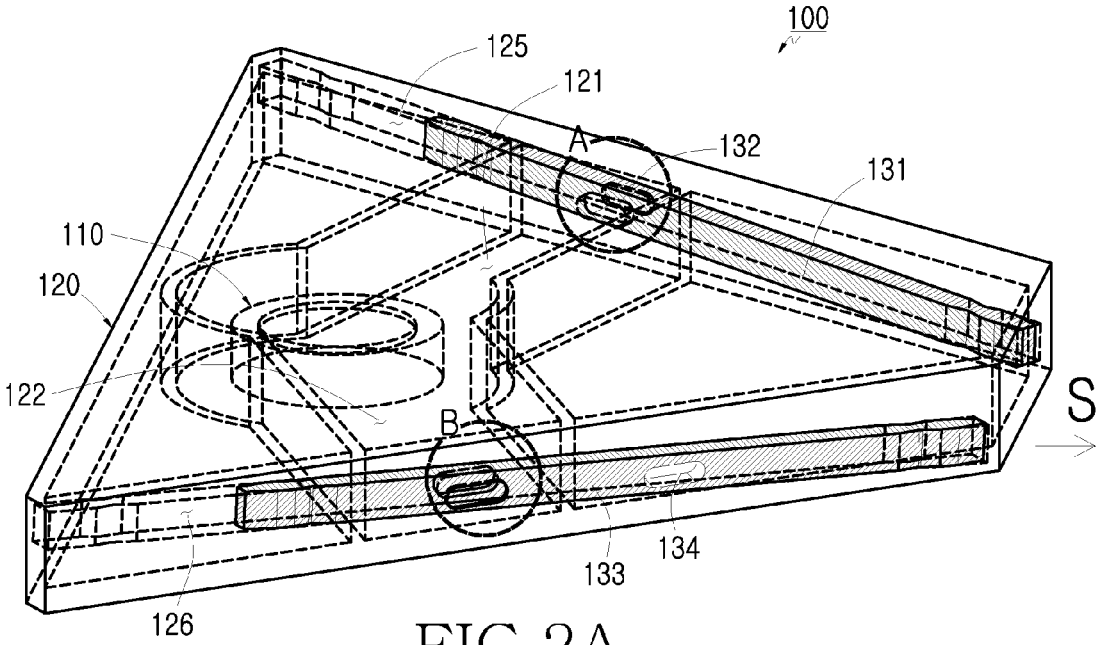
FIG. 2A illustrates a top cross-sectional perspective view of a structure of a speaker apparatus according to the first embodiment of the present invention of FIG. 1.
Figure 2B:
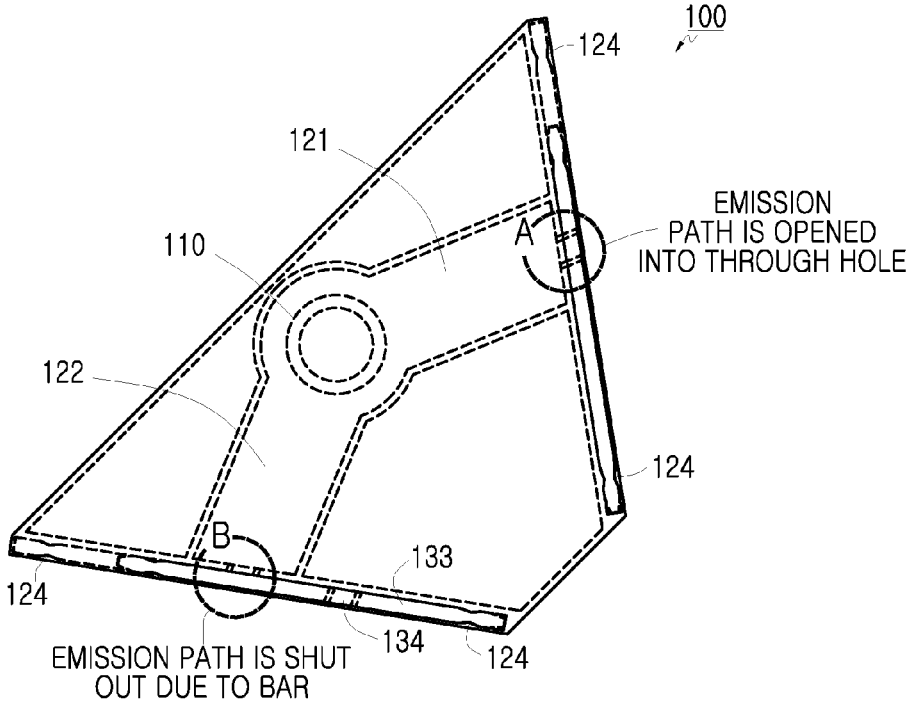
FIG. 2B illustrates a top cross-sectional plan view of the structure of FIG. 2A according to the first embodiment of the present invention of FIG. 1A.

FIGS. 2A-2B illustrate a structure of a speaker apparatus 100 according to the first embodiment of the present invention of FIG. 1. Where similar or identical aspects of the first embodiment have been discussed, a portion of the description for the configuration described above in FIG. 1 will be omitted from the description of FIGS. 2A-2B.

Referring to FIGS. 2A-2B, the first guide part 125 for the first bar 131 and the second guide part 126 for the second bar 133 are slantingly installed to each extend longitudinally generally in a direction labeled S in FIG. 2A. Accordingly, although the speaker apparatus 100 is positioned to be oriented vertically or horizontally as shown in the upper and lower views of FIG. 1, respectively, the first bar 131 and the second bar 133 may move slidably in the S direction under their own respective weight due to the influence of the vertically directed gravity, as shown in FIG. 1. Accordingly, regardless of whether the portable terminal including the speaker apparatus 100 is positioned on a horizontal structure, with one portion of the portable terminal being at the bottom as in the upper view in FIG. 1, or with another portion of the portable terminal being at the bottom as in the lower view in FIG. 1, an emission path for emitting a speaker sound may be determined. As shown in FIGS. 2A-2B, when the speaker apparatus 100 is rotated to be oriented as shown in the lower view of FIG. 1, the first bar 131 moves and, as shown in insert A in FIGS. 2A-2B, connects the first emission path 121 with the first through hole 132 of the first bar 131. The second bar 133 moves and, as shown in insert B in FIGS. 2A-2B, the portion of the second bar 133 without the second through hole 134 is positioned adjacent the second emission path 122, and so shuts out or blocks the second emission path 122.

In addition, each of the first bar 131 and the second bar 133 has a streamlined configuration and may be easily moved in each of the corresponding first guide part 125 and second guide part 126, respectively. Alternatively or in addition, the bars 131, 133 may engage the guide parts 125, 126, respectively, with ball bearing mechanisms known in the art to facilitate movement of the bars 131, 133 within their respective guide parts 125, 126. In additional alternative embodiments, each of the bars 131, 133 may be coated with a lubricant, to facilitate movement of the bars 131, 133 within each respective guide part 125, 126. In a further alternative embodiment, each of the bars 131, 133 may be composed of at least polytetrafluoroethylene, or alternatively coated with polytetrafluoroethylene, commercially available as "TEFLON" from "DUPONT CORPORATION", to facilitate movement of the bars 131, 133 within each respective guide part 125, 126.

In addition, each of the first guide part 125 and the second guide part 126 may include at least one or more projections 124, as shown in FIG. 2B, which frictionally engage the bars 131, 133, to obstruct movement of each of the bars 131 and 133. If movement of the portable terminal 100 exceeds a certain degree while each of the bars 131 and 133 is held by each of the corresponding projections 124, each of the bars 131 and 133 may be separated and moved from each of the corresponding projections 124.

Figure 3:
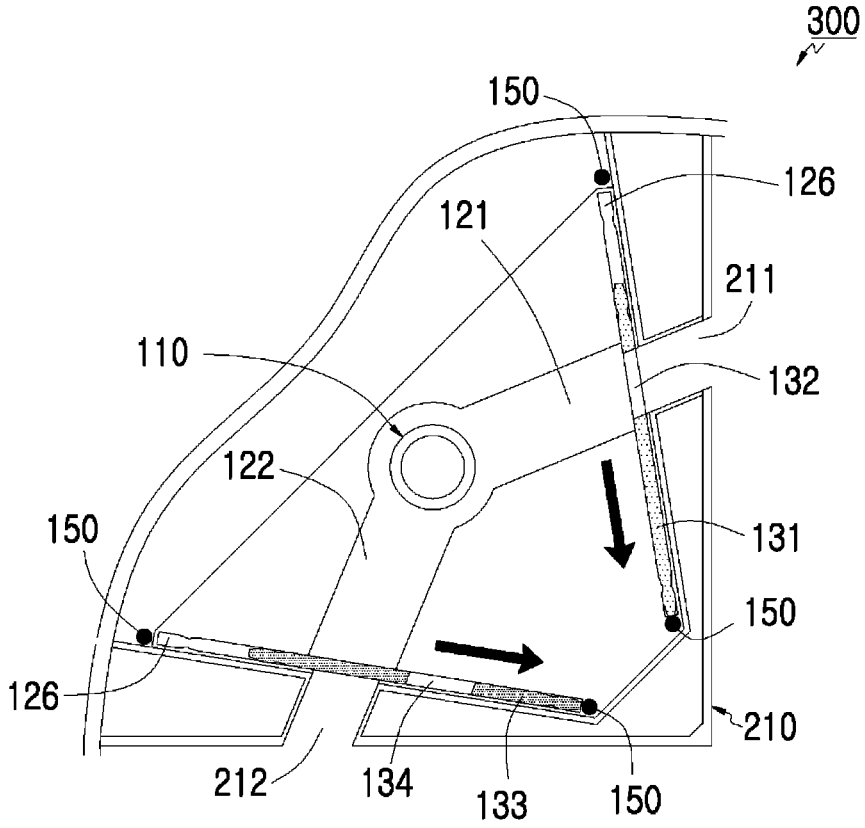
FIG. 3 illustrates an alternative configuration of a speaker apparatus according to a second embodiment of the present invention.

FIG. 3 illustrates a configuration of a speaker apparatus according to a second embodiment of the present invention.

Referring to FIG. 3, the speaker apparatus denoted by 300 includes the generally the same elements as those of FIG. 1 and FIGS. 2A-2B. Herein, it is assumed that the first guide part 125 and the second guide part 126 are formed to extend substantially parallel to respective internal surfaces of the body 120. The speaker apparatus 300 may include at least one electromagnet 150 capable of generating an electromagnetic field for attraction for moving the bars 131 and 133 within their respective guide parts 125, 126. Accordingly, in one example embodiment shown in FIG. 3, pairs of electromagnets 150 are positioned at either end of the guide parts 125, 126. Each end of the bars 131, 133, oriented near a respective electromagnet 150, would include a magnetically-sensitive metallic component, which may include, for example, iron, such that, when one of the electromagnets 150 is activated, the respective metallic end of the bars 131, 133 near the activated electromagnet 150 would be magnetically attracted, and so would move the corresponding one of the bars 131, 133 toward the activated electromagnet 15, and thus move within the guide part 125, 126 corresponding to the magnetically attracted one of the bars 131, 133. Because the electromagnet 150 generates the electromagnetic field when an electrical current is supplied, it is possible to perform the following embodiment. For example, if a music listening function is executed, the portable terminal 100 supplies electrical current to the electromagnet 150 of a predetermined position near one of the outlets 211, 212 from which the music is to emanate. Accordingly, a corresponding bar 131, 133 near the activated electromagnet 150 is moved, thus moving one of the through holes 132, 134 to be adjacent to the corresponding emission path 121, 122 and the corresponding outlet 211, 212, and a corresponding emission path may be opened for permitting the speaker sound to be emitted.

Predetermined software or encoded firmware may be used by a controller within the portable terminal to control the activation of the electromagnet 150, for example, in conjunction with an internal gyroscope or other known devices for determining the orientation of the portable device, in order to determine the appropriate outlet 211, 212 to use for emitting the sounds from the speaker 110. The software or encoded firmware may be stored as a software module (or program) configured for execution by one or more controller (processor) in a memory within the portable terminal to control the activation of the electromagnet 150.

Figure 4:
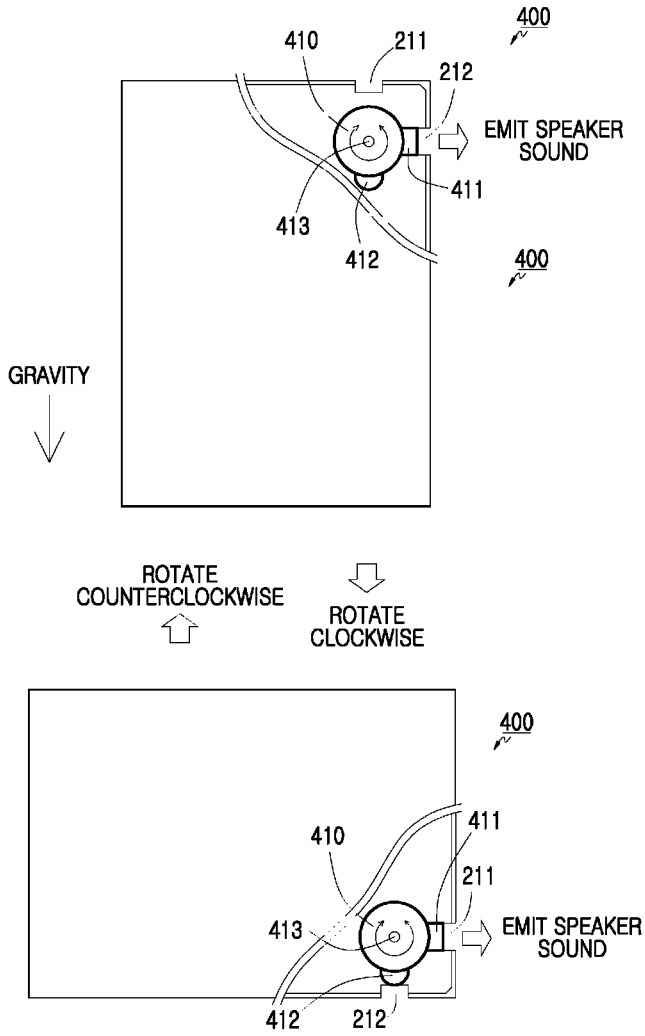
FIG. 4 illustrates another alternative configuration and an operation of a speaker apparatus according to a third embodiment of the present invention.

FIG. 4 illustrates a configuration and an operation of a speaker apparatus according to a third embodiment of the present invention.

Referring to FIG. 4, the speaker apparatus denoted by 400 includes a speaker unit 410, capable of rotating around a center shaft 413, for emitting a sound, corresponding to voice data or other audio data, to a speaker outlet 411 of the speaker unit 410, and a weight member 412 for providing a moment, or alternatively called a torque, to the speaker unit 410 for rotating the speaker unit 410 about the center shaft 413. In addition, a body in which the speaker apparatus 400 is positioned may be formed or provided. The body may include a plurality of outlets 211 and 212 which are opened to the outside of the body. As described above, the body may be replaced with a case frame of a portable terminal.

In accordance with the third embodiment of the present invention, it is assumed herein, solely for the purpose of describing the exemplary embodiments, that the speaker apparatus 400 is installed at a right upper part of a longitudinal (vertical) direction within the body or the case frame, as shown in the upper view of FIG. 4, but it is understood that the speaker apparatus 400 may be positioned in other locations within the body or the case frame in FIG. 4. In addition, as shown in FIG. 4, the weight member 412 and the outlet 411 are disposed relative to each other at an angle of 90 degrees about the center shaft 413. Outlets 211 and 212 installed in the case frame of the portable terminal are also formed to be adjacent to the speaker outlet 411 when the speaker 410 is rotated about the center shaft 413 to position the speaker outlet 411 adjacent to either one of the outlets 211, 212. When the portable terminal is vertically or horizontally positioned, such that the portable terminal is oriented as in the upper view or lower view, respectively, as shown in FIG. 4, the speaker unit 410 rotates about the center shaft 413 due to the moment provided by the weight member 412 and the vertical direction of gravity. The outlet 411 is then open and adjacent to a respective one of the outlets 211, 212 of the case frame.

At least one or more speaker apparatuses described in FIG. 1 to FIG. 4 may be installed at certain locations within the portable terminals. As described above, the speaker apparatus may improve sound quality by selectively emitting a speaker sound to a corresponding outlet, regardless of the orientation of the portable terminal.

In conclusion, the speaker apparatus according to the present invention may improve sound quality by having a plurality of emission paths capable of being selectively used according to the orientation conditions of the portable terminal.

The above-described methods according to the present invention can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A speaker apparatus comprising:

a speaker unit for outputting a sound;

a body including a plurality of emission paths for guiding and emitting the sound output from the speaker unit, the body including a guide part; and a member for opening or shutting at least one of the plurality of emission paths, wherein the member comprises:

a bar that is slidably movable, wherein the guide part is configured to guide movement of the bar, and wherein slidable movement of the bar in a first direction opens at least one of the plurality of emission paths and slidable movement of the bar in a second direction closes at least one of the plurality of emission paths.

2. The speaker apparatus of claim 1, wherein the bar comprises a through hole for being opened to outside the body, and wherein the through hole is opened to or is not opened to the at least one emission path according to the movement position of the bar.

3. The speaker apparatus of claim 1, wherein the guide part is slantingly installed relative to a predetermined surface of the body.

4. The speaker apparatus of claim 1, wherein the guide part comprises at least one projection therein for frictionally engaging the bar for obstructing movement of the bar.

5. The speaker apparatus of claim 1, wherein the bar has a streamlined configuration.

6. The speaker apparatus of claim 1, wherein the body is a case frame having an appearance of a portable terminal.

7. The speaker apparatus of claim 1, wherein the bar, responsive to a load of the bar, moves along a slope of the guide part.

8. The speaker apparatus of claim 1, further comprising at least on electromagnet capable of generating an electromagnetic field when an electrical current is supplied, for moving the bar to a corresponding position in the guide part, wherein the bar includes a metallic member for being attracted by the electromagnetic field.

9. The speaker apparatus of claim 8, wherein the speaker unit, installed in a portable terminal for performing a plurality of functions, supplies the electrical current to the at least one electromagnet when a selected function is performed.

10. An electronic device comprising at least one speaker apparatus according to claim 1.

11. A speaker apparatus comprising:

an external surface with an externally exposed outlet therethrough;

a speaker unit for outputting a sound;

a plurality of internal emission paths for conveying the sound from the speaker unit to the outlet;

a guide adjacent to the outlet; and a bar, slidably movable within the guide, for selectively blocking at least one of the emission paths, thereby controlling the outputting of the sound.

12. The speaker apparatus of claim 11, wherein the bar includes:

a bar surface; and a through hole extending through the bar surface;

wherein, when the bar is in a first position in the guide, the bar surface is adjacent to the emission path and the outlet, thereby blocking the outputting of the sound from the speaker to the outlet; and wherein, when the bar is in a second position in the guide, the though hole is adjacent to the emission path and the outlet, thereby allowing the outputting of the sound from the speaker to the outlet.

13. The speaker apparatus of claim 11, wherein the guide is oriented at a slant relative to the external surface, whereby orientation of the speaker apparatus and gravity cause the movement of the bar in the guide to control the outputting of the sound.

14. The speaker apparatus of claim 11, wherein the guide includes a projection therein for frictionally engaging the bar for obstructing movement of the bar.

15. The speaker apparatus of claim 11, further comprising:

at least one electromagnet, capable of generating an electromagnetic field when an electrical current is supplied, for moving the bar in the guide to control the outputting of the sound, wherein the bar includes at least one metallic member for being attracted by the electromagnetic field when the electrical current is supplied to the electromagnet.

16. The speaker apparatus of claim 15, wherein the at least one metallic member includes:

a pair of metallic members disposed on opposite ends of the bar; and wherein the at least one electromagnet includes:

a pair of electromagnets disposed at opposite ends of the guide, with each electromagnet for attracting a respective metallic member on the bar, thereby moving the bar within the guide to control the outputting of the sound.

* * * * *

UNITED STATES PATENT AND TRADEMARK OFFICE

CERTIFICATE OF CORRECTION

PATENT NO. : 8,891,805 B2
APPLICATION NO. : 13/440329
DATED : November 18, 2014
INVENTOR(S) : Han et al.

It is certified that error appears in the above-identified patent and that said Letters Patent is hereby corrected as shown below:

In the Claims

Column 8, Claim 12, Line 56 should read as follows:
--…the through hole is…--

Signed and Sealed this
Third Day of March, 2015

Michelle K. Lee

Michelle K. Lee
*Deputy Director of the United States Patent and Trademark Office*